US005354988A

United States Patent [19]

Jullien

[11] Patent Number: 5,354,988

[45] Date of Patent: Oct. 11, 1994

[54] POWER SUPPLY FOR MULTIPOLAR MASS FILTER

[75] Inventor: Paul Jullien, Bowdon, England

[73] Assignee: Fisons plc, Ipswich, England

[21] Appl. No.: 70,372

[22] PCT Filed: Oct. 26, 1992

[86] PCT No.: PCT/GB92/01961

§ 371 Date: Jun. 2, 1993

§ 102(e) Date: Jun. 2, 1993

[87] PCT Pub. No.: WO93/08590

PCT Pub. Date: Apr. 29, 1993

[30] Foreign Application Priority Data

Oct. 24, 1991 [GB] United Kingdom ..... 9122598.7

[51] Int. Cl.[5] ..... B01D 59/44; H01J 49/00

[52] U.S. Cl. ..... 250/292; 250/282

[58] Field of Search ..... 250/292, 281, 282

[56] References Cited

U.S. PATENT DOCUMENTS

| | | | |
|---|---|---|---|
| 3,410,998 | 11/1968 | Walters | 250/292 |
| 3,413,463 | 11/1968 | Brubaker . | |
| 3,495,186 | 2/1970 | Wright . | |
| 3,621,464 | 11/1971 | Bryndza et al. . | |
| 3,735,287 | 5/1971 | Lowe . | |
| 3,784,814 | 1/1974 | Sakai et al. | 250/292 |
| 3,829,689 | 8/1974 | Tsukakoshi et al. | 250/292 |
| 4,221,964 | 9/1980 | Schlereth et al. . | |
| 4,506,227 | 5/1982 | Heinen et al. . | |
| 4,703,190 | 10/1987 | Tamura et al. . | |

FOREIGN PATENT DOCUMENTS

| | | |
|---|---|---|
| 45-26679 | 9/1970 | Japan . |
| 2-223145 | 9/1990 | Japan . |
| 543864 | 7/1975 | U.S.S.R. . |
| 813538 | 6/1979 | U.S.S.R. . |
| 917237 | 8/1979 | U.S.S.R. . |
| 1064349 | 7/1982 | U.S.S.R. . |
| 1297131 | 9/1985 | U.S.S.R. . |
| 1457016 | 5/1987 | U.S.S.R. . |
| 2100078 | 5/1982 | United Kingdom . |

OTHER PUBLICATIONS

Pacak, Slabop, Obzor, 1983 vol. 44(10) pp. 475–483.

Toderean, Ristoiu St Cerc. Fix 1976 vol. 28(7) pp. 665–672.

Vyukhin, Kovalev Instrum. Exp. Techniquest 1980 vol. 23(5) pt 1 pp. 1184–1186.

Slomp, Chiasera et al Rev. Sci. Instrum. 1986 vol. 57 (11) pp. 2786–2790.

Zipf, Rev Sci Instrum. 1970 vol. 41 (8) pp. 1236–1237.

Berezhnoi, Mel'nichuk, Instrum. Exp. Techn. 1974 vol. 17(5), pt. 2, pp. 1402–1403.

Shobotenko, Evstifeev, Instrum. and Exp. Technique, 1982 vol. 25(5) pt. 1 pp. 1160–1162.

*Primary Examiner*—Bruce C. Anderson

*Attorney, Agent, or Firm*—Chilton, Alix & Van Kirk

[57] ABSTRACT

A quadrupole mass filter (1) includes a controllable RF oscillator (7) which follows any drift in the resonant frequency of a resonant circuit means (8), this circuit means (8) amplifying an alternating RF potential from the oscillator (7) and supplying it to the filter electrodes (2, 3, 4, 5). To ensure that the charge to mass ratio of the particles transmitted by the filter remains constant, a signal for controlling the amplitude of the oscillator (7) is corrected in response to any resonant frequency shift. This signal is also fed to DC supply means (12, 13, 15), to ensure that the amplitude of the DC potential applied to the electrodes (2, 3, 4, 5) remains in the correct ratio to the RF potential amplitude so that the filter resolution remains constant.

20 Claims, 4 Drawing Sheets

POWER SUPPLY FOR MULTIPOLAR MASS FILTER

This invention relates to a power supply for providing stable RF and DC supplies to the electrodes of a multipolar (eg a quadrupolar) mass filter, and to a method of stabilizing those supplies.

Quadrupole mass filters comprise four elongated electrodes to which time-varying potentials are applied to create a time-varying electrical field of particular characteristics. Ions entering the filter along its central axis undergo motion in the field in such a way that only ions of certain selected mass-to-charge ratios will have stable trajectories and will emerge from the filter to reach an ion detector.

Such a filter requires a radio-frequency supply of controlled amplitude and frequency and positive and negative stabilized DC supplies whose outputs are related to the amplitude and frequency of the RF supply. In simple terms, the center of the band of mass-to-charge ratios that are transmitted is determined by the amplitude and the frequency of the RF supply and the width of the band transmitted (ie, the mass resolution) is determined by the ratio of the DC to the RF amplitudes. Most, but not all, quadrupole mass filters operate at constant radio frequency (typically about 2 MHz), and variable amplitude (to select the mass transmitted).

There are many published designs for stabilized RF/DC generators suitable for quadrupole mass filters. The main problems to be solved are the stabilization of the RF amplitude over a range from almost zero to typically 2000 volts (the range necessary to scan a complete mass spectrum) and the control of the DC potentials in some defined relation to the RF amplitude. One advantage of operation at constant frequency is that the RF generator can be coupled to the filter electrodes by means of a resonant high Q transformer which steps up the RF amplitude to the necessary high value, obviating the need for a solid-state generator capable of generating a waveform of several thousand volts peak-to-peak amplitude.

There are two approaches to the design of suitable RF generators. The most common, especially suitable for high-performance filters, is to generate the RF at low amplitude, typically using a crystal-controlled oscillator operating at the desired frequency, and to use its output signal to drive a tuned power amplifier which is coupled to the filter electrodes through a transformer as described. Supplies of this type are disclosed, for example, by Pacak (Slabop. Obzor, 1983 vol 44 (10) pp 475–483), Toderean and Ristoiu (St. Cerc. Fiz. 1976 vol 28 (7) pp 665–672), V'yukhin and Kovalev (Instrum. & Exp. Tech. 1980 vol 23 (5) pt. 1 pp 1184–6), Tamura and Kitajima in U.S. Pat. No. 4,703,190, and by Bryndza in U.S. Pat. No. 3,621,464. All these publications further describe means by which the RF amplitude is stabilized and set accurately according to a control signal by means of which the mass transmitted by the filter is selected. Typically the generator is operated in a control loop with negative feedback derived from a detector circuit which generates a DC signal indicative of the actual RF amplitude. This is compared with the control signal and the gain of the RF amplifier set accordingly. The DC potentials are either derived by rectification of the RF applied to the electrodes or from separate stabilized DC power supplies controlled by the control signal.

More up-to-date methods of control of the RF and DC amplitudes using digital electronics are exemplified by Slomp, Chiasera, et.al. (Rev. Sci. Instrum. 1986 vol 57 (11) pp 2786–2790), but the principle of operation is the same as the older analogue methods. This, or similar techniques are used in most of the commercial quadrupole spectrometers presently available.

A fundamental difficulty with fixed-frequency RF generators is the need to maintain the resonant frequency of the coupling transformer at exactly the frequency of the oscillator over a long period of time. This is particularly difficult because the capacitance of the quadrupole filter itself forms part of the tuned circuit, and varies with time, temperature and contamination of the filter electrodes. The electrical characteristics of the coupling transformer may also drift with time and temperature. The resultant shift in resonant frequency will cause the load presented to the RF amplifier (operating at the oscillator frequency) to become reactive, so that the voltage magnification of the transformer is greatly reduced. The amplitude of the RF on the filter electrodes can then only be maintained by increasing the output power of the oscillator, which the amplitude stabilization circuit will attempt to do. However, the maximum power of the oscillator will be reached at a lower amplitude than would otherwise be the case, so that the mass range of the filter is reduced and the average power dissipation is increased. This exacerbates the drift problem and reduces long-term reliability. To overcome this, great care must be taken with the design of the power amplifier and particularly the transformer to ensure that drift is minimised, usually resulting in very large and expensive components.

Generators whose frequency determining elements comprise the coupling transformer and mass filter have also been developed, particularly for use with low cost filters. Examples of these "free-running" oscillators and their associated control circuitry are described by Zipf (Rev. Sci. Instrum. 1970 vol 41 (8) pp 1236–7), Berezhnoi and Mel'nichuk (Instrum. & Exp. Tech. 1974 vol 17(5) pt. 2 pp 1402–3) and in SU 813,538 and U.S. Pat. No. 3,735,287. In RF generators of this type the problem of amplitude variation with drift is less severe than in the fixed-frequency type, but any changes in the frequency are still reflected in the mass calibration because the transmitted mass also depends on frequency. There are also problems in designing a free-running oscillator with a sufficient dynamic range of amplitude for a high performance filter. Up to now the use of free-running oscillators has been largely confined to relatively low performance mass filters.

One solution to the problem of maintaining resonance of the coupling transformer when a fixed-frequency oscillator is used is disclosed in U.S. Pat. No. 4,506,227. This patent teaches the use of a transductor for magnetically retuning the coupling circuit in response to any drift in the electrical characteristics of the mass filter.

It is an object of the present invention to provide a multipolar mass filter having a power supply with good long-term stability which is cheaper to construct than prior high-stability filters but is free of the problems associated with the lower cost "free-running" oscillator power supplies. It is a further object to provide methods of stabilizing such a power supply.

The invention provides a multipolar mass filter through which charged particles of selected mass-to-charge ratio may be transmitted in response to the application to its electrodes of an alternating potential of selected amplitude and frequency, said filter comprising resonant circuit means connected to the electrodes of said filter, controllable radio-frequency oscillator means connected to said resonant circuit means for generating said alternating potential at a frequency determined by said resonant circuit means and at an amplitude determined by an amplitude control signal, said mass filter being characterised by means for adjusting the amplitude of said alternating potential in response to changes in the actual frequency of oscillation of said oscillator means in order to maintain the transmission through said filter of charged particles of said selected mass-to-charge ratio.

In one embodiment there may be also provided means for generating a difference signal indicative of the difference in frequency of a reference oscillator and the actual frequency of oscillation of said controllable RF oscillator means, means for multiplying said difference signal by a first amplitude control signal to generate a product signal, means for generating a corrected amplitude control signal dependent on said product signal and said first amplitude control signal, and means for applying said corrected amplitude control signal to said controllable RF oscillator means to adjust the amplitude of said alternating potential.

In a more preferred embodiment there may be provided means for correcting said amplitude control signal before its application to said controllable RF oscillator means by a signal dependent on the actual frequency of oscillation of said controllable RF oscillator means. That is, the amplitude control signal may be passed through a signal multiplying means whose output signal is the product of the amplitude control signal and a signal related to the actual frequency of oscillation. The output of the signal multiplying means is then used to control the amplitude of the alternating potential produced by the controllable RF oscillator means. In this way the ratio of the actual amplitude of the alternating potential to the value demanded by the amplitude control signal is varied to compensate for a change in frequency of the oscillator means.

In preferred embodiments means are provided for stabilizing the output amplitude of the controllable radio-frequency oscillator means with respect to the value demanded by the control signal applied to it. Means are also provided for applying direct potentials to the filter electrodes to adjust the mass resolution of the filter, and for stabilizing these potentials relative to the control signal corrected for any changes in frequency as defined above to ensure that the ratio of the amplitudes of the alternating and direct potentials remains substantially constant at a predetermined value necessary for maintaining the demanded resolution.

Conveniently, the means for correcting comprises a timing oscillator for controlling a gate through which a signal representative of the frequency of the alternating potential passes to a counter, means for squaring the digital count accumulated in the counter during a time determined by the timing oscillator, and a digital-to-analogue converter for generating the amplitude control signal, the digital-to-analogue converter receiving an analogue signal for setting the mass-to-charge ratio of charged particles to be transmitted by the filter and being arranged to multiply it by the output of the means for squaring.

Stabilization of the amplitude of the alternating potential may conveniently be effected by rectifying a sample of the output of the oscillator means and applying this signal in a negative feedback arrangement to the amplitude control input of the oscillator means, as in prior types of RF power supplies.

A preferred embodiment of the controllable RF oscillator means comprises a low-power oscillator whose frequency is determined by a control signal, a radio-frequency power amplifier driven by the low-power oscillator, means for monitoring the current drawn by the amplifier, means for repeatedly changing the frequency of the low-power oscillator over a limited range centred on a nominal frequency, which changes are small enough to have no significant effect on the performance of the mass filter, and means responsive to changes in the current drawn by said power amplifier consequent upon the repeated frequency changes for adjusting the nominal frequency of the low power oscillator until the changes in the current drawn substantially correspond to the changes expected when the frequency of the low-power oscillator is equal to the resonant frequency of the resonant circuit means. Further preferably, the means responsive to the current changes is further responsive to the amplitude control signal, means being provided for comparing at two or more measurement times during any one of the repeated frequency changes the actual current drawn by the amplifier with the current expected to be drawn when the frequency of the oscillator is equal to the resonant frequency of the resonant circuit means according to the value of the amplitude control signal at the measurement time, and means being provided for adjusting the nominal frequency of the oscillator until the actual and expected currents at each of the measurement times are substantially equal.

In an alternative but less preferred embodiment the controllable oscillator means comprises a low-power oscillator and radio-frequency power amplifier as described above, and a phase detector for comparing the phase of the input and output signals of the amplifier connected in a control loop to set the frequency of the oscillator so that the phase difference between the amplifier input and output is minimized. This situation occurs when the oscillator frequency is coincident with the resonant frequency of the resonant circuit means, so that the oscillator frequency is locked to the resonant frequency by the action of the control loop.

The invention further provides a method of operating a multipolar mass filter through which charged particles of a selected mass-to-charge ratio may be transmitted and to which is applied through resonant circuit means an alternating potential whose frequency is determined by said resonant circuit means and whose amplitude is determined by an amplitude control signal, said method being characterized by adjusting the amplitude of said alternating potential in response to changes in the actual frequency of said alternating potential to maintain the transmission through said mass filter of said charged particles of selected mass-to-charge ratio.

In preferred methods the amplitude of the alternating potential is stabilized with respect to the value demanded by the control signal, corrected for any changes in frequency as defined above. Direct potentials are preferably also applied to the electrodes of the mass filter to adjust its resolution and are also stabilized with respect to the control signal corrected as described, so that the ratio of the amplitudes of the direct and alternating potentials is kept precisely constant at the value required for the demanded mass resolution, even when the amplitude has been adjusted to compensate for a change in the actual oscillation frequency.

A further preferred method comprises the steps of:

a) passing a signal representative of the frequency of the alternating potential through a gate for a period of time determined by a timing oscillator;

b) counting the signal representative of the frequency for as long as said gate is open;

c) squaring the count accumulated during step b) and converting the result to a correction signal;

d) correcting the amplitude control signal by the correction signal to adjust the amplitude of the alternating potential to maintain the transmission of the charged-particles of selected mass-to-charge ratio through the filter, irrespective of the frequency of said alternating potential.

A still further preferred method comprises the additional steps of:

a) generating the alternating potential by means of a low power variable-frequency oscillator;

b) amplifying the alternating potential by an amplifier whose gain is determined by an amplitude control signal;

c) repeatedly changing the frequency of the alternating potential over a limited range about a nominal frequency, the limited range being small enough to have no significant effect on the performance of said mass filter;

d) monitoring the current drawn by the amplifier used in step b) during the repeated frequency changes; and e) adjusting the nominal frequency of the oscillator until the repeated current changes substantially correspond with those expected when said nominal frequency is coincident with the resonant frequency of the resonant circuit means.

Further preferably, the method described above further comprises the steps of comparing at two or more measurement times during any one of said repeated frequency changes the actual current drawn by the amplifier with the current expected to be drawn when the oscillator frequency is equal to the resonant frequency of the resonant circuit means according to the value at the measurement time of the amplitude control signal, and adjusting the nominal frequency of the oscillator until the measured and expected currents at each measurement time are substantially equal.

A preferred embodiment of the invention will be described in detail by way of example and with reference to the figures, wherein.

Figure 1:
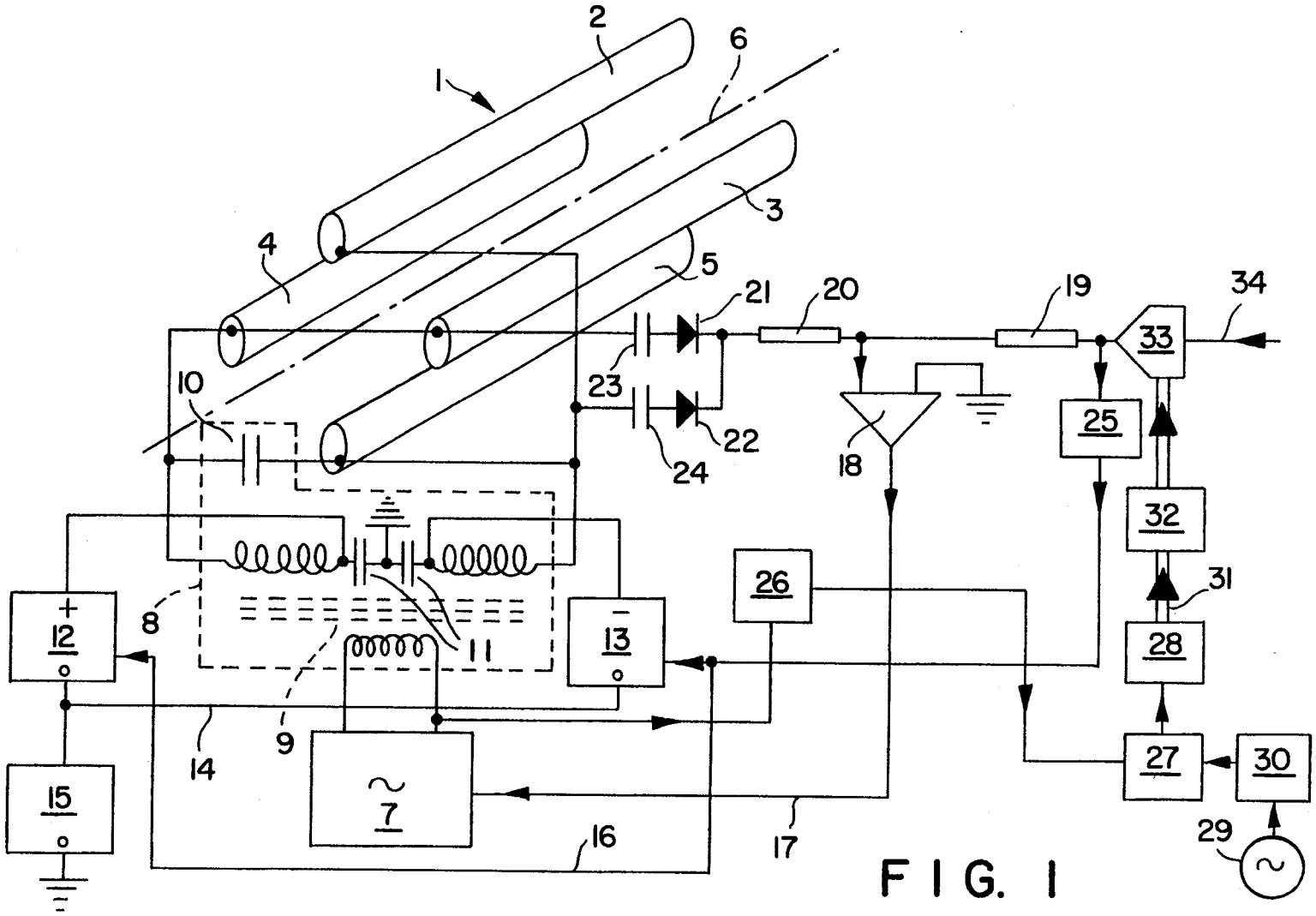
FIG. 1 is a drawing illustrating the principle of operation of a quadrupolar mass filter according to the invention.

Referring to FIG. 1, a quadrupolar mass filter 1 comprises four elongate electrodes 2–5 symmetrically disposed about an axis 6 along which charged particles enter. Electrode 2 is connected to electrode 5, and electrode 3 is connected to electrode 4. An alternating potential is generated by a controllable radio-frequency oscillator means 7 and is applied to the electrodes 2–5 via a resonant circuit means 8 which comprises a radio-frequency transformer 9, a tuning capacitor 10 and decoupling capacitors 11. These components, together with the capacitance of the electrodes 2–5, comprise a parallel tuned circuit with a resonant frequency equal to the desired frequency of oscillation of the oscillator means 7. Feedback, discussed in detail below, is provided within the oscillator means 7 to ensure oscillation at that resonant frequency.

Direct potentials are applied to the electrodes 2–5 in addition to the alternating potential by a stabilized positive direct potential supply 12 and a stabilized negative direct potential supply 13 whose outputs are connected to the "cold" ends of the secondary windings of transformer 9 and decoupled by capacitors 11. Because the two supplies are of equal voltage, this arrangement results in the potential of the axis 6 being equal to the "zero volts" connection 14 of the power supplies 12 and 13. A pole-bias power supply 15 is connected between the connection 14 and ground to allow the potential of the axis 6 to be shifted a few volts relative to ground as in many prior types of quadrupole filters. The actual values of the potentials generated by supplies 12 and 13, which control the resolution of the filter, are set by a control signal on the connection 16.

The amplitude of the RF oscillator means 7 is controlled by an analogue signal applied to the connection 17. This signal is generated by a summing amplifier 18 which receives a control signal for demanding a particular RF amplitude through a resistor 19 and an amplitude stabilization signal through a resistor 20. The amplitude stabilization signal is derived by rectification of the alternating potential on electrodes 2–5 by diodes 21 and 22 which are connected to the electrodes by very low capacitance capacitors 23 and 24. These components form a negative feedback control loop which stabilizes the amplitude of the alternating potential at the value demanded by the control signal applied to resistor 19. Capacitors 23 and 24 are selected to have a very high impedance in comparison with that of the diodes 21 and 22 in order to minimize the effect of diode non-linearity. Other refinements, known from prior designs, may be incorporated in this control loop to further minimize the non-linearity and provide good control over the very wide range of amplitude necessary.

As in all quadrupole mass filters the direct potentials applied to the electrodes must be proportionally related to the amplitude of the alternating potential. In the FIG. 1 embodiment this is achieved by the potential divider 25 which receives the control signal for the RF oscillator means 7 and generates the control signal on connection 16 for the power supplies 12 and 13. The potential divider 25 is adjusted to obtain the desired ratio of alternating to direct potentials and may simply comprise a manually operated potentiometer for setting the filter resolution. More conveniently, the divider 25 is controlled by a digital signal generated by a computer or microprocessor which controls the operation of the mass filter. Means (not shown in FIG. 1) may also be provided to adjust the ratio in response to the demanded RF amplitude to ensure optimum performance over the entire mass range in the instrument. Such adjustment is a feature of many prior mass filters and need not be described in detail.

A sample of the output of the RF oscillator means 7 is passed through a waveform shaper 26 (which generates a rectangular waveform having a frequency equal to that of the oscillator means 7) and through a gate 27 to a counter 28, which counts the pulses in the signal from the shaper 26 while the gate 27 is open. The gate 27 is controlled by a timing oscillator 29 and a divider 30, so that the counter 28 periodically generates a signal on a bus 31 which is representative of the frequency of the oscillator means 7. This signal is squared by a squarer 32 (discussed in detail below) to produce a signal representative of the square of the frequency of the oscillator means 7. The latter signal controls a digital-to-analogue convertor (DAC) 33 whose reference input is an analogue control signal on connection 34 for setting the filter potentials to transmit a particular mass-to-charge ratio. The output of the DAC 33 provides an amplitude control signal to the summing amplifier 18 via the resistor 19. The DAC 33 therefore multiplies the analogue control signal on connection 34 by a factor dependent on the square of the actual oscillation frequency of the oscillator means 7.

In accordance with the invention the oscillator means 7 is allowed to oscillate at whatever frequency is determined by the resonant circuit means 8, and a signal representative of its actual frequency is used to vary the amplitude of the alternating potential applied to the rods, thereby correcting the calibration of the filter for any change in the actual oscillation frequency. No attempt is made to change the frequency of the oscillator means 7 to a value other than the resonant frequency of the resonant circuit means 8 so that the high magnification factor of that circuit is always maintained. Consequently the resonant circuit means 8 does not need to have very high frequency stability and the problem of drift in the capacitance of the electrodes themselves is eliminated. For example, in many prior mass filters the transformer 9 and the tuning capacitor 10 are bulky and expensive air-spaced components, but in a filter according to the invention the transformer 9 can be replaced with a much smaller component wound on a ferrite toroid.

For optimum performance the time for which gate 27 is open to admit the pulses from the shaper 26 into the counter 28 should be such that the accumulated count on the bus 31 which is fed to the DAC 33 sets the output of the latter to approximately half of the analogue input on connection 34. The timing oscillator 29 preferably comprises a quartz-crystal controlled oscillator running at approximately 1 MHz, and the division ratio of the divider 30 is chosen to give a gate time in accordance with this requirement. However, other frequencies and division ratios may be more suitable in different cases.

The need for the squarer 32 is a consequence of the fundamental equations which govern transmission of charged particles through the mass filter. The theory of operation of such filters is well known and will not be presented in detail. The mass-to-charge ratio M which is transmitted when the filter is operating at the apex of the a–q scan diagram (that is, when the ratio of the RF and DC potentials is such that only a single mass-to-charge ratio is transmitted) may be represented by the equations:

$$M = \frac{V}{k_1 f^2 r_o^2}$$

and

-continued $$M = \frac{U}{k_2 f^2 r_o^2}$$

Where f is the frequency of the alternating potential of amplitude V, U is the direct potential difference between the electrodes, $r_o$ is the radial distance from the axis 6 to the electrodes 2–5, and $k_1$ and $k_2$ are constants. Thus the transmitted mass is proportional to the amplitude of the alternating potential but inversely proportional to the square of the frequency f. Consequently, in the present invention wherein a change in frequency is compensated by a corrective change in amplitude, the change must be made proportionally to the square of the frequency to maintain the mass calibration of the filter.

Figure 2:
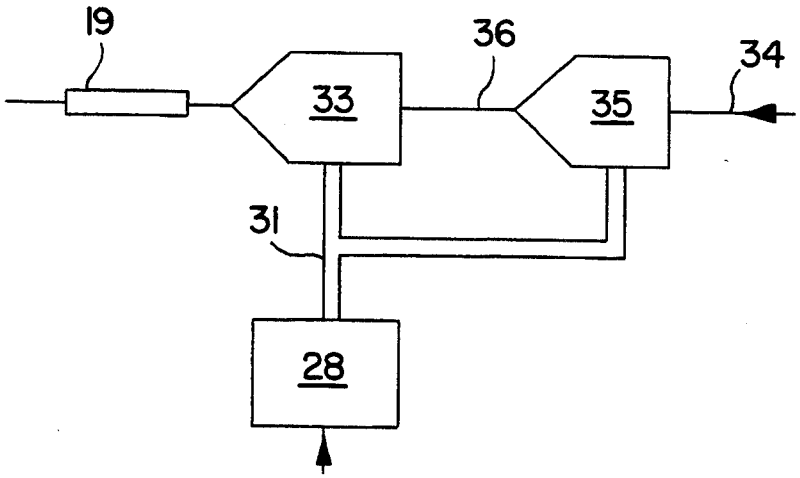
FIG. 2 is a drawing illustrating a squarer suitable for use in the filter of FIG. 1.

Squarer 32 may be implemented in several ways. The digital signal appearing on bus 31 may be input to a suitable digital multiplier (which might be a suitably programmed microprocessor) which will generate a second digital signal at the input of DAC 33 which is the square of that on bus 31. Alternatively a second DAC 35, connected as shown in FIG. 2, can be employed. In this version the control signal on input connection 34 is passed through the two DAC's in series, each controlled by the digital signal on the bus 31. If, for example, the signal on bus 31 was 50% of the value required to set the DAC's to full output, DAC 35 will set the output on connection 36 to 50% of the value of the input connection 34, and DAC 33 will set the output to resistor 19 to 50% of the signal on connection 36, ie, 25% of the input signal.

Figure 3B:
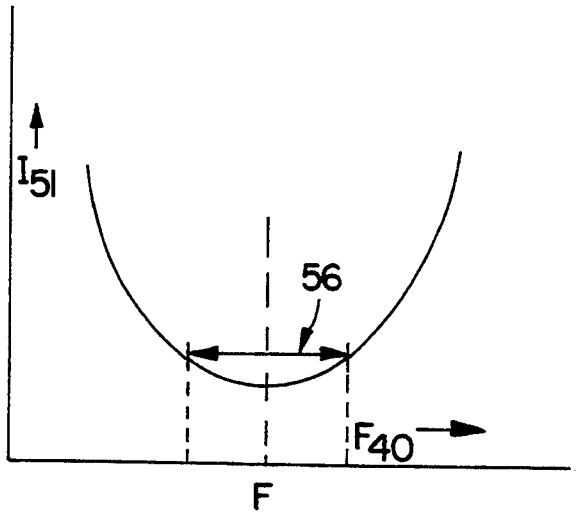
FIG. 3B is a drawing illustrating how the current drawn by an amplifier suitable for use in the invention varies with frequency.
Figure 3A:
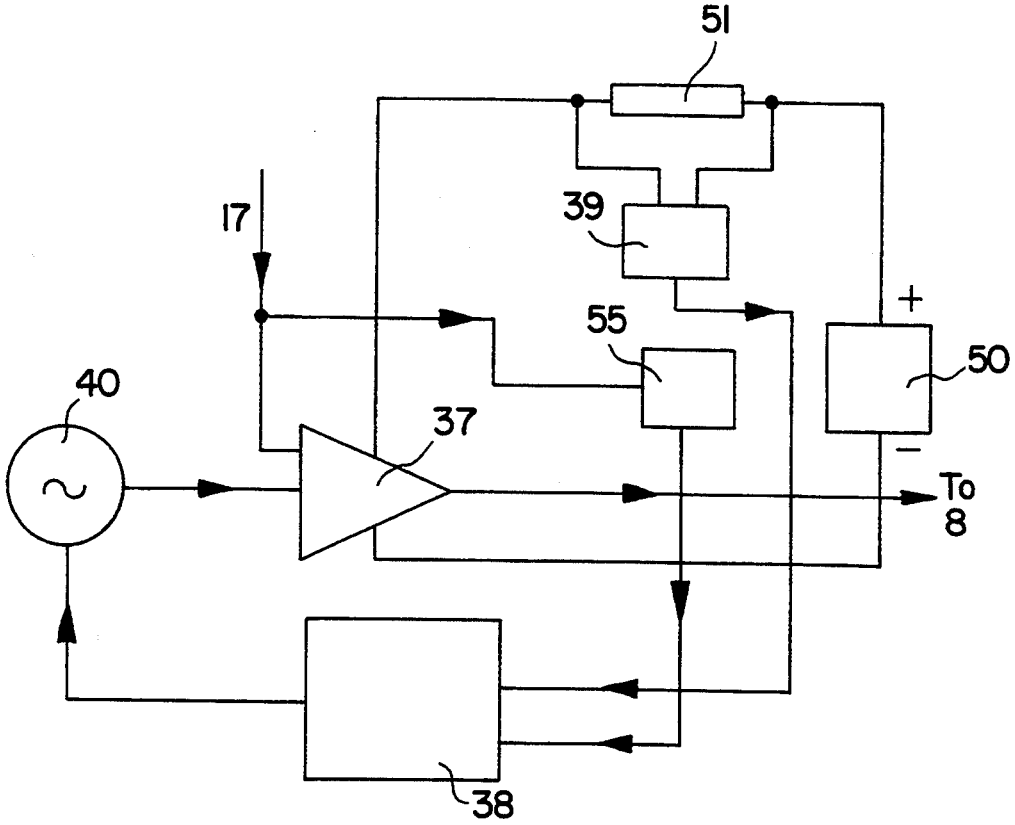
FIG. 3A is a drawing illustrating an oscillator suitable for use in the filter of FIG. 1.

A preferred embodiment of the oscillator means 7 is shown in FIG. 3A. It comprises an RF power amplifier 37 whose gain is controlled by the analogue signal on connection 17 and whose output is connected to the resonant circuit means 8 (FIG. 1). The amplifier 37 is powered from a direct voltage supply 50 via a low value resistor 51. A low-power oscillator 40, conveniently a frequency synthesiser, drives the amplifier 37 at a frequency determined by a digital control signal on its input 52. The potential appearing across the resistor 51 is digitized by an analogue-to-digital convertor 39, thereby providing means for monitoring the current drawn by the amplifier 37. A microprocessor 38 controls the frequency of the oscillator 40 by its connection to the input 52 and is programmed to repeatedly change the frequency of the oscillator 40 by a small amount (selected to have no significant effect on the performance of the mass filter). As with any tuned power amplifier, the current drawn from the supply 50 will be dependent on its actual operating frequency relative to the resonant frequency of the resonant circuit means 8, as illustrated in FIG. 3B. The current will be a minimum when the two frequencies are coincident, and will increase as shown in FIG. 3B by a small amount as the microprocessor 38 repeatedly changes the nominal frequency f over the limited range 56. When the nominal frequency is coincident with the resonant frequency, the current will increase approximately the same amount for equal frequency excursions on either side of f, but if f is not coincident with the resonant frequency the current will decrease in one direction and increase in the other. Microprocessor 38 therefore monitors the digitized signal received from the A–D convertor 39 and adjusts the nominal frequency f of the oscillator 40 until the current changes indicate that f is equal to the resonant frequency. Allowance must also be made for the circumstance where the current drawn by the amplifier 37 is changing as a consequence of variations in the demanded output voltage occasioned by mass scanning. This is achieved by the microprocessor comparing the actual current drawn by the amplifier at two or more measurement times in any given frequency excursion with the currents expected at the corresponding instantaneous value of the amplitude control signal on connection 17. To do this, an analogue-to-digital convertor 55 is provided to provide a digitized version of the control signal on connection 17 for the microprocessor. The expected values of current for the resonant condition are obtained from a look-up table of current against amplitude control signal for the resonant condition, and any deviation of the actual currents from the expected currents is recognized by the microprocessor which consequently changes the oscillator frequency until the actual and expected currents are the same. The look-up table is built in a suitable digital memory when the instrument is first switched on. On switching on, the amplitude control signal is disabled and the oscillator frequency set to the resonant frequency by the method previously described. The mass filter is then scanned over the entire mass range while the microprocessor stores measured current values against particular values of the control signal in the look-up table. Operation is then switched to the second mode in which the microprocessor compares the actual currents with the expected currents, allowing correction even while the amplitude control signal is varying.

Figure 5:
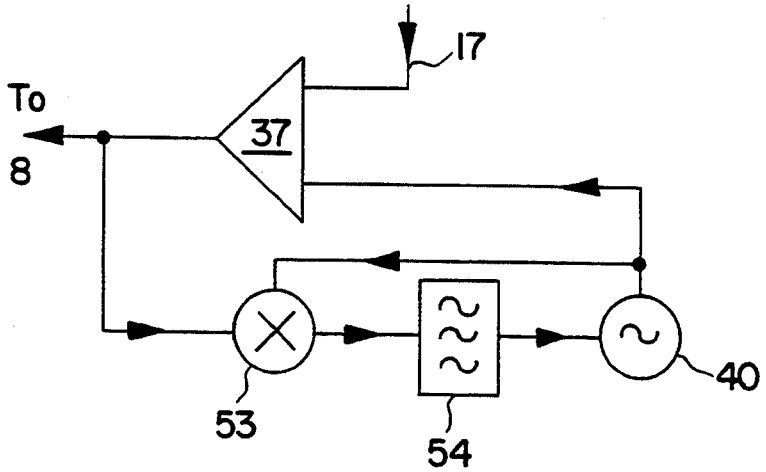
FIG. 5 is a drawing illustrating an alternative oscillator suitable for use in the invention.

A less preferred embodiment of the oscillator means 7 is shown in FIG. 5. It comprises an RF power amplifier 37 whose gain is controlled by the analogue signal on connection 17 and whose output is connected to resonant circuit means 8 as shown in FIG. 1. In place of positive feedback from the amplifier output to its input, a phase-locked loop comprising a phase detector 53, a low-pass filter 54 and a low power oscillator 40 comprising a voltage controlled oscillator (VCO) is provided. The VCO 40 is designed to run at the nominal oscillation frequency required of the oscillator means 7. In the FIG. 3 embodiment it is locked to the resonant frequency of the resonant circuit means 8 by means of a phase-locked loop. On switching on the power to the oscillator means 7, the VCO 40 commences to oscillate at its nominal frequency, and the RF power amplifier 37 amplifies that signal. If the resonant frequency of the resonant circuit means 8 does not correspond with the frequency of the VCO 40, a reactive load is presented to the power amplifier 37 and a phase difference develops between its output and the output of the VCO. This is immediately detected by the phase detector 53 which applies a frequency correction signal to the VCO 40 via the low pass filter 54, thereby locking the VCO frequency to the resonant frequency of the resonant circuit means 8. This arrangement facilitates starting of the power oscillator and operation at low demanded RF amplitudes is facilitated because the amplitude of the VCO output is independent of the demanded RF amplitude which is determined by the gain of the RF amplifier 37.

Figure 4:
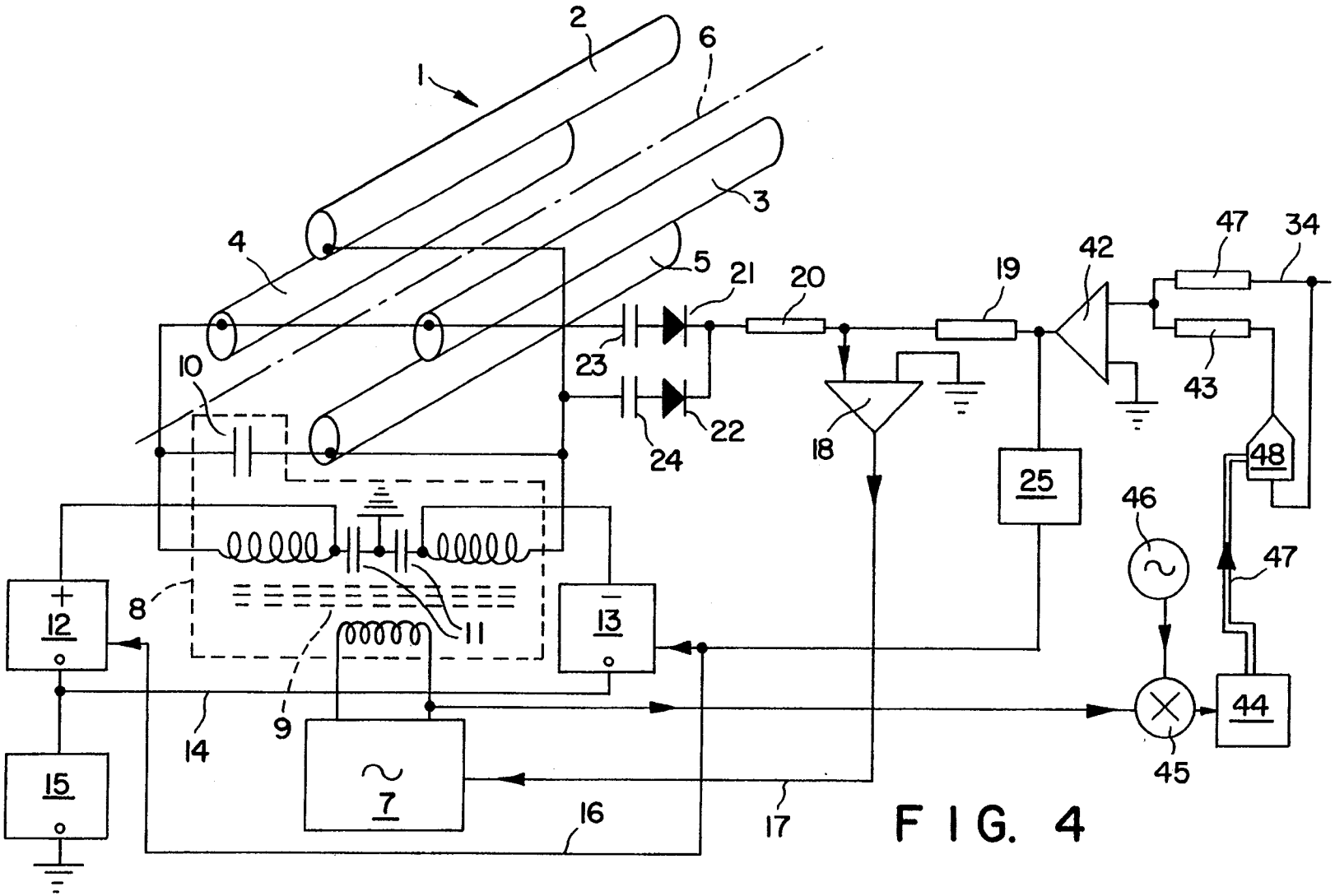
FIG. 4 is a drawing illustrating an alternative form of a quadrupolar mass filter according to the invention.

FIG. 4 illustrates a similar but less preferred embodiment of a mass filter according to the invention. The control signal on connection 34 passes via an input resistor 47 and a second summing amplifier 42 to the resistor 19 to control the amplitude of the alternating and direct potentials as in the embodiment shown in FIG. 1. The frequency of a sample of the alternating potential generated by the oscillator means 7 is compared with that of a reference oscillator 46 by a mixer 45 to give a difference signal indicative of the difference in frequency of the two oscillators. Oscillator 46 conveniently operates at the nominal frequency of the oscillator means 7. A digital version of the difference signal is generated by a frequency counter and processor 44, and is applied via bus 49 to a digital-to-analogue converter 48 which is connected as a multiplier in the manner previously described for the DAC 33 in the FIG. 1 embodiment. DAC 48 produces a product signal indicative of a first amplitude control signal (on connection 34) multiplied by the difference signal. This is added to the first amplitude control signal by a second summing amplifier 42 and its associated input resistors 43 and 47 to generate a corrected amplitude control signal which is used to adjust the amplitude of the alternating potential to compensate for changes in the frequency of the alternating potential. It will be noted that the DC potential control signal fed to the potential divider 25 is derived from the output of the amplifier 42 so that the DC potentials are related to the corrected amplitude of the alternating potential, thereby maintaining the resolution of the mass filter independent of any changes in frequency.

This method of compensating for drift of the oscillator means 7 is based on the equations discussed above, from which it can be seen that if the amplitude control signal $V_{corr}$ is to be set to compensate for a drift $\Delta f$ from the nominal frequency $f_R$ of the reference oscillator in such a way that the mass-to-charge ratio of the ions transmitted is to be unaffected, then $$\frac{V_{set}}{f_R^2} = \frac{V_{corr}}{(f_R + \Delta f)^2}$$

where $V_{set}$ is the control signal on connection 34. Rearranging and expanding this equation, and ignoring the very small term $\Delta f^2$ the following is obtained:

$$V_{corr} = V_{set} + V_{set}.k.\Delta f$$

in which k is a constant ($f_R$ is of course a constant). This relationship is implemented in the FIG. 4 embodiment by first generating the difference signal $\Delta f$ at the output of the mixer 45, converting this to a suitable digital signal and multiplying it by the constant k in the counter/processor 44, and then generating a product signal by multiplying it by the signal $V_{set}$ by the DAC 48. The product signal is then added to the signal $V_{set}$ on connection 34 by means of the summing amplifier 42, as required by the equation.

It will be appreciated that other ways of correcting the amplitude control signal for a drift in the frequency of the oscillator means 7 are within the scope of the invention. Further, although in the embodiments disclosed the frequency of the oscillator means 7 is maintained at the resonant frequency of the resonant circuit means 8 by a phase-locked loop, other ways of achieving this are also within the scope of the invention. For example, means may be provided to adjust the frequency of the oscillator means 7 to maintain the minimum current through, or the maximum voltage across, the resonant circuit means 8, both conditions corresponding to identity between the resonant frequency and actual oscillator frequency.

It will be further appreciated that the invention is not limited to a quadrupole mass filter but embraces any mass filter arrangement where an alternating potential is required and where the amplitude and frequency of that potential determine the transmitted masses. For example, the invention may be used with monopole mass filters or with quadrupole ion traps operated in certain modes. Further, the invention is not limited to the generation of sinusoidal RF waveforms, and may be applied to mass filters where the alternating potential is differently shaped, for example a rectangular waveform.

I claim:

1. A multipolar mass filter (1) through which charged particles of a selected mass-to-charge ratio may be transmitted in response to the application to its electrodes of an alternating potential of selected amplitude and frequency, said filter comprising resonant circuit means (8) connected to the electrodes (2–5) of said filter, controllable radio-frequency oscillator means (7) for generating said alternating potential at a frequency determined by said resonant circuit means (8) and at an amplitude determined by an amplitude control signal, said mass filter being characterized by means (26–33, 18, 19) for adjusting the amplitude of said alternating potential in response to changes in the actual frequency of oscillation of said oscillator means (7) in order to maintain the transmission through said filter of charged particles of said selected mass-to-charge ratio.

2. A multipolar mass filter as claimed in claim 1 further comprising means (27–33) for correcting said amplitude control signal by a signal dependent on the actual frequency of said controllable radio-frequency oscillator means (7) before said amplitude control signal is applied to said oscillator means (7) to set the amplitude of said alternating potential.

3. A multipolar mass filter as claimed in claim 2 wherein a means for correcting comprises a timing oscillator (29–30) for controlling a gate (27) through which a signal representative of the frequency of said alternating potential passes to a counter (28), means (32) for squaring the digital count accumulated in said counter during a time determined by said timing oscillator (29, 20) and a digital-to-analogue convertor (33) for generating said amplitude control signal, said digital-to-analogue convertor receiving an analogue signal for setting the mass-to-charge ratio of charged particles to be transmitted by the filter and arranged to multiply it by the output of said means for squaring (32).

4. A multipolar mass filter as claimed in claim 3 wherein said controllable RF oscillator means (7) comprises a low-power oscillator (40) whose frequency is determined by a control signal, a radio-frequency power amplifier (37) driven by the output of said low-power oscillator (40) and a phase detector (53, 54) for comparing the phase of the input and output of said radio-frequency power amplifier connected in a control loop to set the frequency of said low-power oscillator so that the phase difference between said input and said output is minimized.

5. A multipolar mass filter as claimed in claim 3 wherein said controllable RF oscillator means (7) comprises a low-power oscillator (40) whose frequency is determined by a control signal, a radio-frequency power amplifier (37) driven by said low-power oscillator (40), means (51-39) for monitoring the current drawn by said amplifier (37), means for repeatedly changing the frequency of said low-power oscillator (40) over a limited range centered on a nominal frequency, which changes are small enough to have no significant effect on the performance of said mass filter, and means (38, 39), responsive to changes in the current drawn by said power amplifier (37) consequent upon said repeated frequency changes, for adjusting said nominal frequency of said low-power oscillator (40) until said changes in the current drawn substantially correspond to the changes expected when the frequency of said low-power oscillator is equal to the resonant frequency of said resonant circuit means (8).

6. A multipolar mass filter as claimed in claim 2 further comprising means (20–24, 18) for stabilizing the output amplitude of said controllable radio-frequency oscillator means (7) relative to said amplitude control signal.

7. A multipolar mass filter as claimed in claim 6 further comprising means (12, 13, 15) for applying direct potentials to the filter electrodes, and means for stabilizing said direct potentials relative to said amplitude control signal so that the ratio of said direct potentials and said alternating potentials is maintained substantially at a predetermined value.

8. A multipolar mass filter as claimed in claim 7 wherein said means for correcting comprises a timing oscillator (29–30) for controlling a gate (27) through which a signal representative of the frequency of said alternating potential passes to a counter (28), means (32) for squaring the digital count accumulated in said counter during a time determined by said timing oscillator (29, 20) and a digital-to-analogue convertor (33) for generating said amplitude control signal, said digital-to-analogue convertor receiving an analogue signal for setting the mass-to-charge ratio of charged particles to be transmitted by the filter and arranged to multiply it by the output of said means for squaring (32).

9. A multipolar mass filter as claimed in claim 1 further comprising means (20–24, 18) for stabilizing the output amplitude of said controllable radio-frequency oscillator means (7) relative to said amplitude control signal.

10. A multipolar mass filter as claimed in claim 1 further comprising means (12, 13, 15) for applying direct potentials to the filter electrodes, and means for stabilizing said direct potentials relative to said amplitude control signal so that the ratio of said direct potentials and said alternating potentials is maintained substantially at a predetermined value.

11. A multipolar mass filter as claimed in claim 1 wherein said controllable RF oscillator means (7) comprises a low-power oscillator (40) whose frequency is determined by a control signal, a radio-frequency power amplifier (37) driven by the output of said low-power oscillator (40) and a phase detector (53, 54) for comparing the phase of the input and output of said radio-frequency power amplifier connected in a control loop to set the frequency of said low-power oscillator so that the phase difference between said input and said output is minimized.

12. A multipolar mass filter as claimed in claim 1 wherein said controllable RF oscillator means (7) comprises a low-power oscillator (40) whose frequency is determined by a control signal, a radio-frequency power amplifier (37) driven by said low-power oscillator (40), means (51–39) for monitoring the current drawn by said amplifier (37), means for repeatedly changing the frequency of said low-power oscillator (40) over a limited range centered on a nominal frequency, which changes are small enough to have no significant effect on the performance of said mass filter, and means (38, 39), responsive to changes in the current drawn by said power amplifier (37) consequent upon said repeated frequency changes, for adjusting said nominal frequency of said low-power oscillator (40) until said changes in the current drawn substantially correspond to the changes expected when the frequency of said low-power oscillator is equal to the resonant frequency of said resonant circuit means (8).

13. A multipolar mass filter as claimed in claim 12 wherein said means (38, 39) responsive to changes in the current drawn by said power amplifier (37) is further responsive to said amplitude control signal, means (38) are provided for comparing at two or more measurement times during any one of said repeated frequency changes the actual current drawn by said amplifier with the current expected to be drawn when the frequency of said oscillator is equal to the resonant frequency of said resonant circuit means according to the value at said measurement time of said amplitude control signal, and means (38) are provided for adjusting the nominal frequency of said low-power oscillator (40) until said actual and expected currents at each said measurement time are substantially equal.

14. A method of operating a multipolar mass filter (1) through which charged particles of a selected mass-to-charge ratio may be transmitted and to which is applied through resonant circuit means (8) an alternating potential whose frequency is determined by said resonant circuit means and whose amplitude is determined by an amplitude control signal, said method being characterized by adjusting the amplitude of said alternating potential in response to changes in the actual frequency of said alternating potential to maintain the transmission through said mass filter of said charged particles of selected mass-to-charge ratio.

15. A method of operating a multipolar mass filter as claimed in claim 14 further comprising stabilizing the amplitude of said alternating potential with respect to said amplitude control signal and applying to the electrodes of said filter direct potentials which are also stabilized with respect to said amplitude control signal to maintain the ratio of said direct potentials to said alternating potential at a predetermined value.

16. A method as claimed in claim 15 further comprising the steps of:

a) passing a signal representative of the frequency of said alternating potential through a gate for a period of time determined by a timing oscillator;

b) counting said signal representative of said frequency for as long as said gate is open;

c) squaring the count accumulated during step b) and converting the result to a correction signal;

d) correcting said amplitude control signal by said correction signal to adjust the amplitude of said alternating potential to maintain the transmission of said charged-particles of selected mass through said filter, irrespective of the frequency of said alternating potential.

17. A method as claimed in claim 16 further comprising the steps of:

a) generating said alternating potential by means of a low-power variable-frequency oscillator;

b) amplifying said alternating potential by an amplifier whose gain is determined by an amplitude control signal;

c) repeatedly changing the frequency of said alternating potential over a limited range about a nominal frequency, said limited range being small enough to have no significant effect on the performance of said mass filter;

d) monitoring the current drawn by the amplifier used in step b) during said repeated frequency changes;

e) adjusting said nominal frequency until said repeated current changes substantially correspond with those expected when said nominal frequency is coincident with the resonant frequency of said resonant circuit means.

18. A method as claimed in claim 14 further comprising the steps of:

a) passing a signal representative of the frequency of said alternating potential through a gate for a period of time determined by a timing oscillator;

b) counting said signal representative of said frequency for as long as said gate is open;

c) squaring the count accumulated during step b) and converting the result to a correction signal;

d) correcting said amplitude control signal by said correction signal to adjust the amplitude of said alternating potential to maintain the transmission of said charged-particles of selected mass through said filter, irrespective of the frequency of said alternating potential.

19. A method as claimed in claim 14 further comprising the steps of:

a) generating said alternating potential by means of a low-power variable-frequency oscillator;

b) amplifying said alternating potential by an amplifier whose gain is determined by an amplitude control signal;

c) repeatedly changing the frequency of said alternating potential over a limited range about a nominal frequency, said limited range being small enough to have no significant effect on the performance of said mass filter;

d) monitoring the current drawn by the amplifier used in step b) during said repeated frequency changes;

e) adjusting said nominal frequency until said repeated current changes substantially correspond with those expected when said nominal frequency is coincident with the resonant frequency of said resonant circuit means.

20. A method as claimed in claim 19 further comprising the step of comparing at two or more measurement times during any one of said repeated frequency changes the actual current drawn by said amplifier with the current expected to be drawn when said frequency is equal to the resonant frequency of said resonant circuit means according to the value at said measurement time of said amplitude control signal, and adjusting said nominal frequency until said measured and said expected currents at each said measurement time are substantially equal.

* * * * *